US005725410A

United States Patent [19]

Robinson et al.

[11] Patent Number: 5,725,410

[45] Date of Patent: Mar. 10, 1998

[54] PROJECTILE AND LAUNCHER TOY

[76] Inventors: Allan Brooks Robinson, R.R. #1; Russell Victor Robinson; Kelly Thomas Robinson, both of R.R. #2, all of Dunsford, Ontario, Canada, K0M 1L0

[21] Appl. No.: 718,442

[22] PCT Filed: Apr. 12, 1995

[86] PCT No.: PCT/CA95/00208

§ 371 Date: Oct. 8, 1996

§ 102(e) Date: Oct. 8, 1996

[87] PCT Pub. No.: WO95/28212

PCT Pub. Date: Oct. 26, 1995

[30] Foreign Application Priority Data

Apr. 14, 1994 [CA] Canada ..... 2121278

[51] Int. Cl.[6] ..... A63H 27/01

[52] U.S. Cl. ..... 446/62; 446/63

[58] Field of Search ..... 446/62–67; 244/153 R, 244/154

[56] References Cited

U.S. PATENT DOCUMENTS 3,222,816 12/1965 Effinger, Jr. et al. ..... 446/60

FOREIGN PATENT DOCUMENTS 165755 9/1949 Austria ..... 446/62

208199 8/1940 Switzerland ..... 446/62

*Primary Examiner*—Mickey Yu

*Attorney, Agent, or Firm*—Banner & Witcoff, Ltd.

[57] ABSTRACT

A toy is composed of a projectile and a tube for launching the projectile into the air. The projectile has a pair of wings symmetrically disposed about a longitudinal axis. The leading edge of the wings normally extend outwardly at an oblique angle from a nose which defines the forward end of the projectile. In that position, the projectile will fly through the air. The wings are spring-biased into position for flying. When a manual force opposed to such biasing is applied to the wings, the wings fold inwardly such that the leading edges pivot toward each other. When the wings are closed, the projectile is in a pre-launching position. The projectile is launched into the air via a tube which is hollow and open at one end through which the projectile exits from the tube.

10 Claims, 3 Drawing Sheets

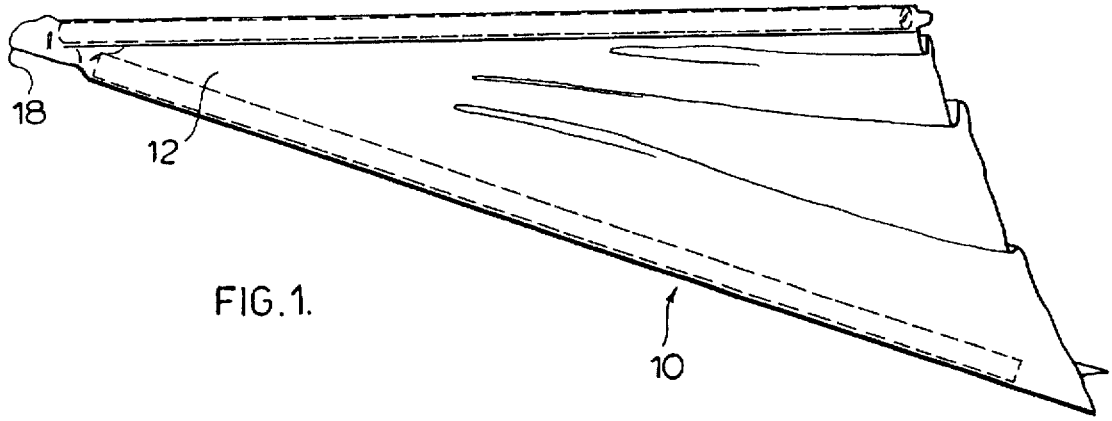
FIG. 1.
FIG. 2.
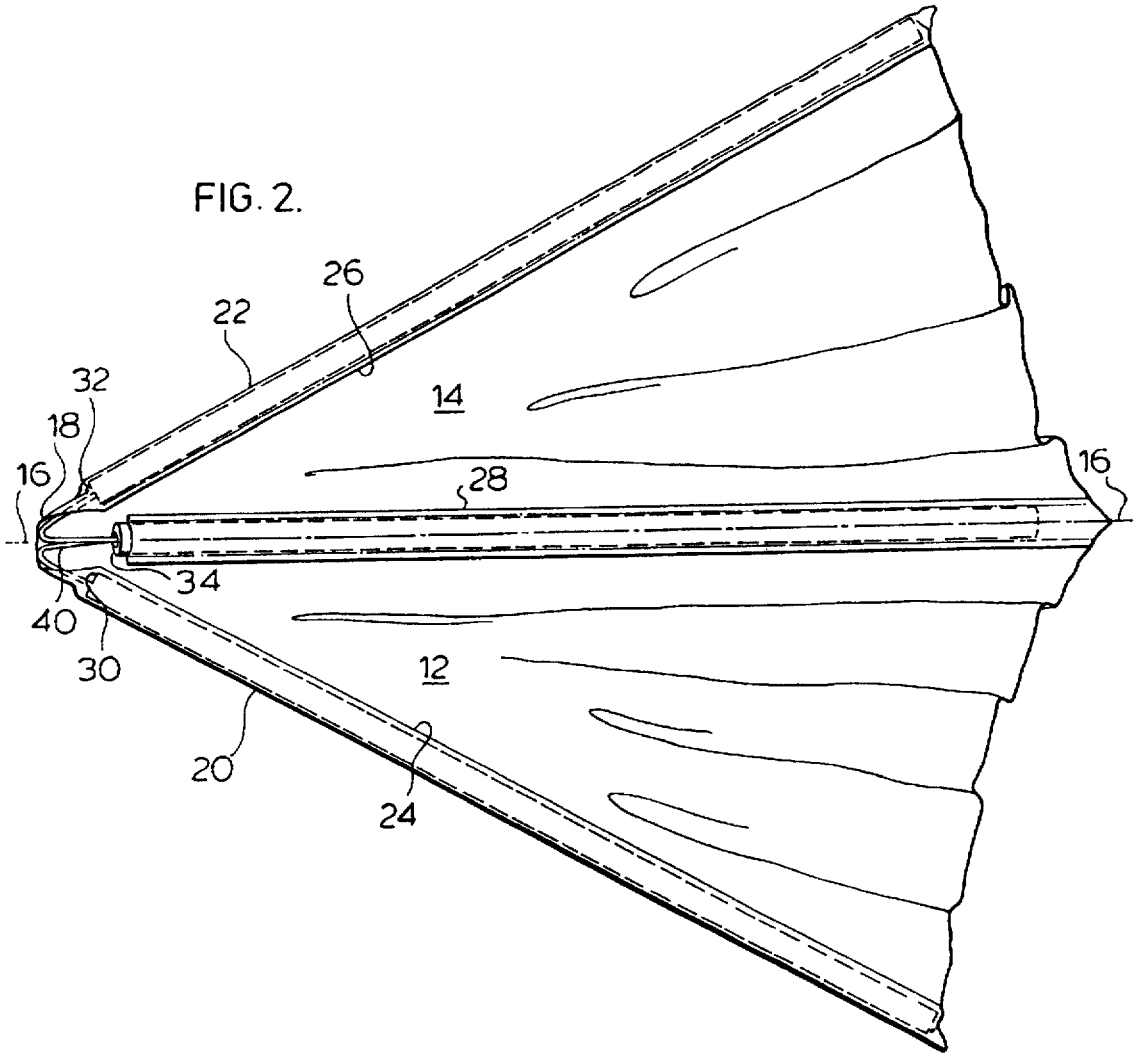

PROJECTILE AND LAUNCHER TOY

BACKGROUND OF THE INVENTION

This invention relates to a toy composed of a projectile and a tube for launching the projectile into the air. The projectile of the invention has wings which are biased together when the projectile is within a tube but which open when the projectile is launched from the tube.

Devices are known for launching projectiles such as balls into the air. Examples of such devices are shown in U.S. Pat. No. 1,570,632 to Kideney, U.S. Pat. No. 1,008,073 to Sato, U.S. Pat. No. 3,589,349 to Parker, U.S. Pat. No. 734,752 to Ring and U.S. Pat. No. 1,585,446 to Warwick. These devices are composed of cups of various structures for receiving the balls. Handles are attached to the cups so that the cups may be held and swung through the air to propel the balls from the cups. The balls follow a generally arc-shaped trajectory as they travel through the air. It is primarily gravity that determines the trajectory.

The shape or structure can be varied so that air currents will have a significant bearing on the path that the projectile follows in the air. It has been found that if the projectile has wings which open when the projectile is launched, the projectile will soar in the air and will remain aloft for a significantly longer period of time than projectiles in the shape of balls.

SUMMARY OF THE INVENTION

The projectile of the subject invention has a pair of wings symmetrically disposed about a longitudinal axis. The wings are normally in a position for flying in which their leading edges extend outwardly at an oblique angle with respect to the longitudinal axis from a nose which defines the forward end of the projectile. Resilient means is provided for biasing the wings into the position for flying. The wings, by applying a force manually opposed to the biasing means, fold inwardly with resulting pivoting of the leading edges toward each other until the wings are in a pre-launching position. The projectile is launched into the air by means of a tube which is hollow and open at one end through which the projectile exits from the tube.

DESCRIPTION OF THE DRAWINGS

The projectile and launching tube of the invention are described with reference to the accompanying drawings in which:

FIG. 1 is a perspective view of the projectile in position for flight;

FIG. 2 is a plan view of the projectile in position for flight;

Like reference characters refer to like parts throughout the description of the drawings.

DESCRIPTION OF THE PREFERRED EMBODIMENT

Figure 3:
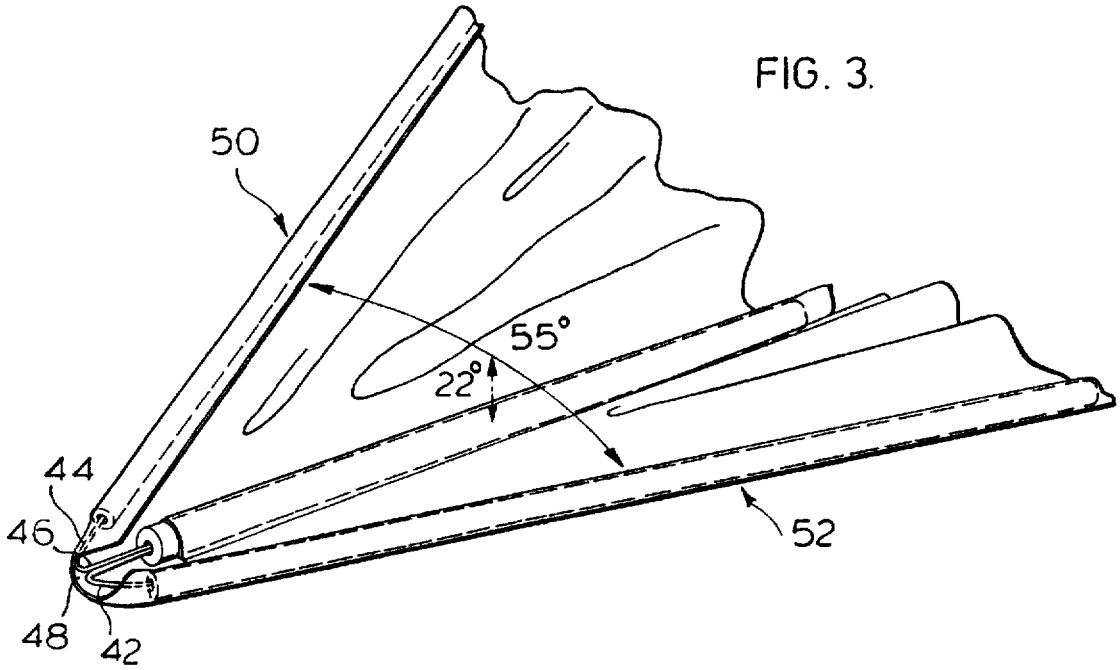
FIG. 3 is a perspective view of the projectile in the process of being folded to a pre-launching position.
Figure 4:
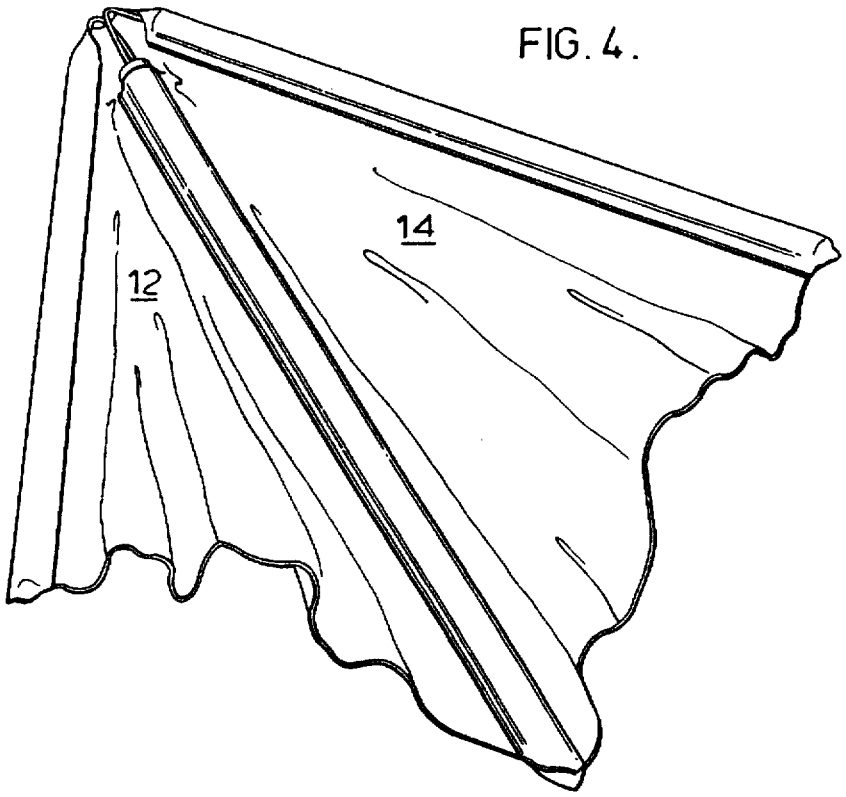
FIG. 4 is view of the sides of the projectile opposite those shown in FIG. 3.

With reference to FIGS. 1 and 2, the projectile indicated generally 10 includes a pair of wings 12, 14 which are symmetrically disposed about a longitudinal axis 16—16. A nose 18 defines the forward end of the projectile and the leading edges 20, 22 of the wings extend outwardly from the nose at an oblique angle with respect to the longitudinal axis.

An elongated peripheral sleeve or pocket 24, 26 is disposed adjacent to each leading edge and a central sleeve 28 extends adjacent to the longitudinal axis. The sleeves may be composed of the same material as the wings and are attached to the wings by sewing, heat-sealing or by other suitable means. Tubes or rods 30, 32 and 34 are received in sleeves 24, 26 and 28 respectively as a means of reinforcing the projectile.

A wire 40 or other elongated resiliently deformable material is disposed at the forward end of the projectile. As illustrated in FIG. 3, the wire is composed of three segments 42, 44 and 46 which diverge from a common point of connection 48. The point of connection is adjacent to the nose of the projectile and each segment extends into and is frictionally secured to a separate reinforcing means.

The wire holds tube 34 such that its axis is offset from the imaginary plane in which the axes of tubes 30, 32 lie by an angle in the range of 15 degrees to about 30 degrees. Preferably the angle of offset is about 22 degrees. The angle between the axes of tubes 30, 32 is in the range of from about 40 degrees to about 70 degrees, preferably 55 degrees.

The wire holds the projectile in an open position for flying as illustrated in FIGS. 1 and 2 but, being resiliently deformable, allows the wings to be folded together. FIG. 3 shows the wings when they are fully open. The wings may be folded toward each other in the direction of arrows 50, 52 as illustrated in FIG. 3. When the wings are adjacent to each other the projectile may be inserted in the launching tube 60 illustrated in FIG. 5.

Figure 5:
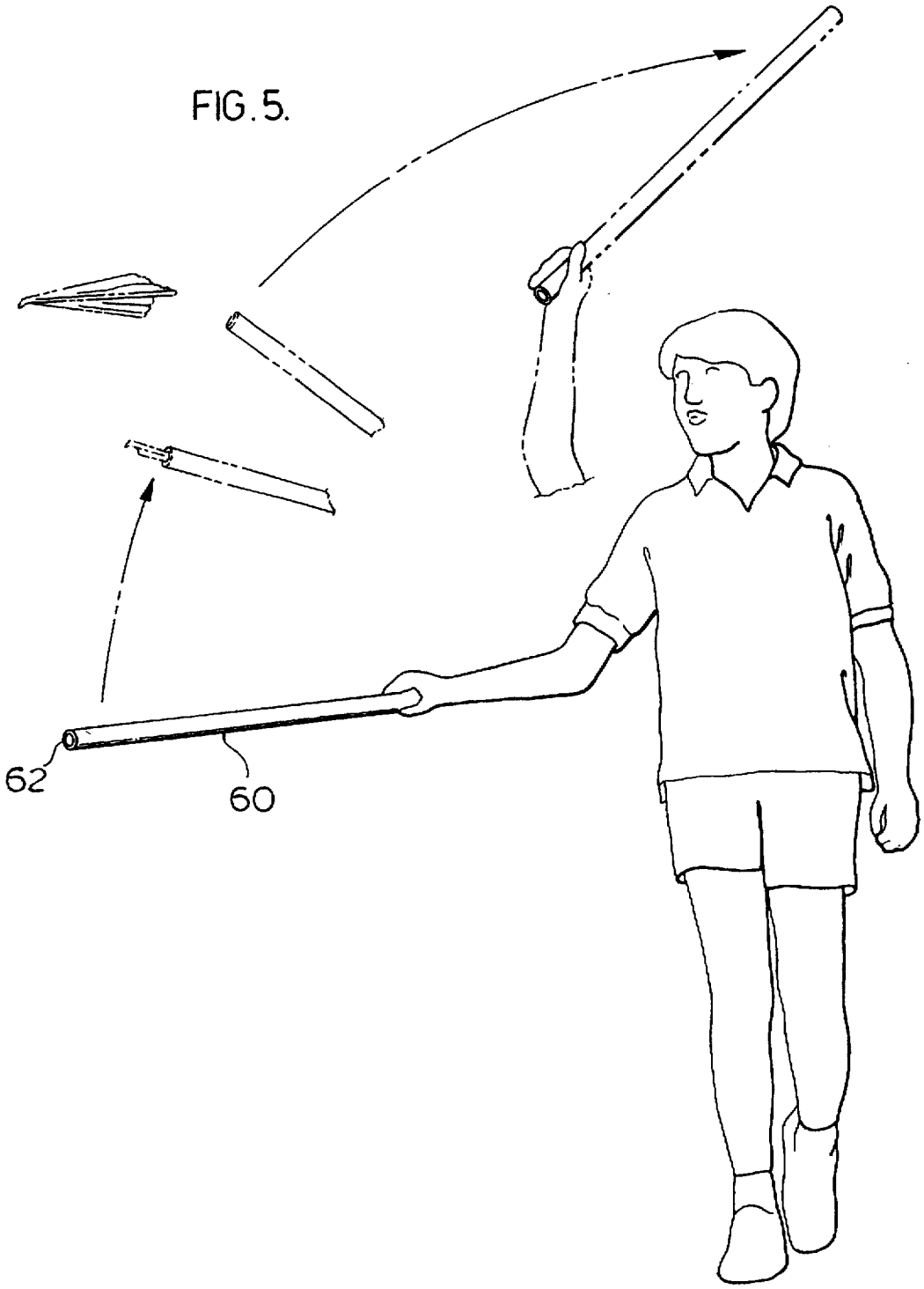
FIG. 5 is a view of the projectile and launching tube, showing the manner in which the projectile is launched.

In FIG. 5, launching tube 60 is composed of a tube which is hollow and open at both its forward end 62 and its rear end. The inside diameter of the tube must be large enough to receive the projectile when its wings are folded and not to grip the projectile when it is within the tube so that the projectile becomes lodged in the tube and cannot be propelled from it.

In operation the projectile is inserted into the rear end of the launching tube and is launched simply by swinging the tube upwardly so that its forward end follows the path of an arc in the air. The tube must be swung rapidly in order to develop sufficient centrifugal force to cause the projectile to fly from the launching tube.

Preferably wire 40 is composed of spring steel of diameter in the range of from about 0.04 inch to about 0.06 inch. The wings and sleeves are preferably composed of flexible material such as nylon, dacron or other polymeric material weighing in the range of from about 0.5 to about 1.5 ounces per square yard. The reinforcing tubes or rods are preferably composed of light weight polyethylene, polypropylene, wood or other relatively inflexible material of specific gravity in the range of from about 0.75 to about 0.11. Material below this range will in general be too weak and material above this range will be too heavy and will shorten the time that the projectile is in flight.

The tubes or rods 30, 34 adjacent to the leading edges of the wings are of substantially similar weight to ensure that the projectile is level in the air and is not lopsided. The combined weights of the two tubes or rods should not exceed approximately 66% of the weight of the central tube or rod 32. If the former tubes or rods weigh more, the projectile will turn over in the air as soon as it is launched and fly upside down. The launching tube may be composed of polyethylene or polypropylene.

The preferred dimensions of the projectile and the reinforcing rods or tubes are as follows: The length of the longitudinal axis of the projectile is about 8 inches, the length of the leading edges is about 7.875 inches and the length of the trailing edges is about 7.25 inches. The launching tube may have an inside diameter of approximately 1.25 inch and the tube is about 24 inches long.

It will be understood of course that modifications can be made in the preferred embodiment illustrated and described herein without departing from the scope and purview of the invention as defined in the appended claims.

We claim:

1. A projectile and a launching tube in combination, said tube being hollow and open at one end, wherein the projectile exits from the open end of the tube, said projectile comprising:

a nose, said nose defining a forward end of the projectile;

a pair of wings, each one of said pair of wings having a leading edge, each of said pair of wings being symmetrically disposed about a longitudinal axis of said projectile, wherein when said wings are in a position for flying, said leading edges extend outwardly at an oblique angle with respect to the longitudinal axis, said pair of wings being inwardly foldable to a prelaunching position such that each said leading edge is configured to pivot toward the longitudinal axis;

a peripheral sleeve disposed on each said wing and adjacent to each said leading edge;

a central sleeve extending adjacent to the longitudinal axis;

a plurality of reinforcing members, one of said reinforcing members being disposed within each said peripheral sleeve and said central sleeve, wherein each said reinforcing member is elongated and substantially inflexible; and a wire comprising a resilient deformable material, said wire biasing said pair of wings into the position for flying, said wire comprising first, second, and third segments diverging from a common point of connection, wherein the common point is disposed at said nose, said first segment being connected to said reinforcing member disposed within said central sleeve, said second and third segments connected to different ones of said reinforcing members disposed within each said peripheral sleeve, and said reinforcing members disposed within said peripheral sleeves being pivotally connected to said reinforcing member disposed within said central sleeve.

2. The combination as claimed in claim 1, wherein said wire is composed of spring steel of diameter in the range of from about 0.04 inch to about 0.06 inch.

3. The combination as claimed in claim 1 wherein said wings are composed of flexible material weighing in the range of from about 0.5 to about 1.5 ounces per square yard.

4. The combination as claimed in claim 1 wherein said reinforcing member is composed of strong, relatively inflexible material of specific gravity in the range of from about 0.75 to about 0.11.

5. The combination as claimed in claim 1 wherein each said reinforcing member in each said peripheral sleeve is of substantially similar weight and their combined weights do not exceed approximately 66 per cent of the weight of the reinforcing member in the central sleeve.

6. The combination as claimed in claim 1 wherein the angle between the axes of the reinforcing means in the two peripheral sleeves is in the range of from about 40 degrees to about 70 degrees.

7. The combination as claimed in claim 1 wherein the angle between the axes of the reinforcing means in the two peripheral sleeves is about 55 degrees.

8. The combination as claimed in claim 1 wherein the axis of the reinforcing means in the central sleeve is offset from the imaginary plane in which the axes of the reinforcing means in the two peripheral sleeves lie by an angle in the range of between about 15 degrees and about 30 degrees.

9. The combination as claimed in claim 1 wherein the axis of the reinforcing means in the central sleeve is offset from the imaginary plane in which the axes of the reinforcing means in the two peripheral sleeves lie by an angle of about 22 degrees.

10. The combination as claimed in claim 4 wherein each said reinforcing member in each said peripheral sleeve is of substantially similar weight and their combined weights do not exceed approximately 66 per cent of the weight of the reinforcing member in the central sleeve.

* * * * *